US008998630B2

(12) United States Patent
DeVries et al.

(10) Patent No.: US 8,998,630 B2
(45) Date of Patent: Apr. 7, 2015

(54) NON-CONDUCTIVE MATERIAL WITH PEAKS AND VALLEYS SURROUNDING A PLURALITY OF ELECTRICAL CONTACTS

(71) Applicant: The Boeing Company, Chicago, IL (US)

(72) Inventors: Paul Herbert DeVries, Bellflower, CA (US); Zinovy Royzen, Seattle, WA (US)

(73) Assignee: The Boeing Company, Chicago, IL (US)

( * ) Notice: Subject to any disclaimer, the term of this patent is extended or adjusted under 35 U.S.C. 154(b) by 41 days.

(21) Appl. No.: 13/652,020

(22) Filed: Oct. 15, 2012

(65) Prior Publication Data

US 2014/0106616 A1 Apr. 17, 2014

(51) Int. Cl.
*H01R 13/52* (2006.01)

(52) U.S. Cl.
CPC ..... *H01R 13/521* (2013.01); *H01R 13/5219* (2013.01)

(58) Field of Classification Search
CPC ..... H01R 13/5208; H01R 13/5205; H01R 13/5221; H01R 13/5219; H01R 13/5202; H01R 13/523; H01R 13/5216; H01R 13/5213
See application file for complete search history.

(56) References Cited

U.S. PATENT DOCUMENTS

| | | | | |
|---|---|---|---|---|
| 2,881,406 | A | 6/1955 | Arson | |
| 3,780,328 | A * | 12/1973 | Boddy et al. | 313/579 |
| 4,131,331 | A | 12/1978 | Kendall, Jr. | |
| 4,497,531 | A | 2/1985 | Baker | |
| 4,734,045 | A * | 3/1988 | Hawkins | 439/79 |
| 5,145,410 | A | 9/1992 | Maejima et al. | |
| 5,240,433 | A | 8/1993 | Kato | |
| 5,474,465 | A | 12/1995 | Kobayashi | |
| 5,580,264 | A * | 12/1996 | Aoyama et al. | 439/275 |
| 5,609,496 | A * | 3/1997 | Kilmer et al. | 439/271 |
| 5,611,706 | A * | 3/1997 | Makita et al. | 439/275 |
| 5,664,953 | A * | 9/1997 | Reylek | 439/111 |
| 5,931,699 | A * | 8/1999 | Saito | 439/587 |
| 6,913,486 | B2 * | 7/2005 | Nagayasu et al. | 439/587 |
| 7,033,216 | B2 * | 4/2006 | Ito | 439/587 |
| 8,545,264 | B2 * | 10/2013 | Nawa | 439/587 |
| 2010/0139945 | A1 * | 6/2010 | Dargatz | 174/116 |
| 2010/0304496 | A1 * | 12/2010 | Nielsen et al. | 436/163 |
| 2011/0300731 | A1 * | 12/2011 | Nakamura | 439/271 |

FOREIGN PATENT DOCUMENTS

EP 0 696 827 2/1996

OTHER PUBLICATIONS

UBM Aviation, "Aircraft Technology Engineering & Maintenance: Airline and MRO Technical Ties" [www.ubmaviationnews.com] Oct.-Nov. 2011, Issue 114.

(Continued)

*Primary Examiner* — Chandrika Prasad
(74) *Attorney, Agent, or Firm* — Michael J. Baldauff, Jr.; Baldauff IP, LLC; Clifford G. Cousins

(57) ABSTRACT

Technologies for reducing the risk of fluid-induced electrical shorting in electrical connectors are provided. An electrical connector comprises a non-conductive member interposed between a first end and a second end of the connector that supports electrical contacts configured to conduct an electrical signal through the non-conductive member. The non-conductive member further has one or more peaks disposed on a surface of the non-conductive member between adjacent contacts.

15 Claims, 6 Drawing Sheets

(56) References Cited

OTHER PUBLICATIONS

Federal Register, vol. 75, No. 214, Nov. 5, 2010, Proposed Rules, pp. 68249-68251.

Federal Register, vol. 76, No. 105, Jun. 1, 2011, pp. 31462 & 31643.

Extended European Search Report dated Feb. 6, 2014 in Application No. 13182080.5.

* cited by examiner

SECTION "B-B"

NON-CONDUCTIVE MATERIAL WITH PEAKS AND VALLEYS SURROUNDING A PLURALITY OF ELECTRICAL CONTACTS

BACKGROUND

Electrical connectors on aircraft may be subject to changing atmospheric pressures and temperatures, the build-up of ice, mechanical and wind forces, and other environmental factors that may cause moisture and fluid to penetrate the connector, shortening the life of the connector as well as creating the potential for short-circuits, arcing, and/or other failures of the connectors. It is with respect to these and other considerations that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Methods, structures, and systems are described herein for reducing the risk of fluid-induced electrical shorting between adjacent contacts in electrical connectors. An improved electrical connector includes the addition of projections or peaks to the internal surface of the dielectric between the adjacent contacts that increases the leak-path between the adjacent contacts while simultaneously increasing the surface area to which any potting compound can bond. The application of a low surface energy coating to the peaks may further help prevent fluid migration. The design of the improved electrical connector decreases the possibility of fluid buildup along the internal surface of the dielectric between adjacent contacts, thus reducing the risk of a contact-to-contact electrical short. The improved electrical connector may have increased reliability, thus reducing fire and safety concerns while simultaneously increasing connector longevity.

According to one aspect, an electrical connector comprises a non-conductive member interposed between a first end and a second end of the connector. The non-conductive member is configured to support the contacts of the connector such that the contacts may conduct an electrical signal through the non-conductive member. The non-conductive member further has one or more peaks disposed on the internal surface of the non-conductive member between adjacent contacts.

According to another aspect, a method for reducing the risk of a fluid-induced electrical short between contacts in an electrical connector comprises identifying areas along a surface of a non-conductive member of the electrical connector where fluid buildup between contacts may occur, and disposing one or more peaks on the surface of the non-conducting member between the contacts.

According to a further aspect, a system for reducing the risk of fluid-induced electrical shorts in an electrical connector comprises a shell, a plurality of contacts configured to conduct electrical signals, and a non-conductive member interposed between a first end and a second end of the shell and configured to support the plurality of contacts. The non-conductive member further comprises a peak disposed on a surface of the non-conductive member between at least one pair of adjacent electrical contacts such that a length of a leak-path along the surface of the non-conductive member between the pair of adjacent contacts is greater than a distance between the pair of adjacent contacts.

The features, functions, and advantages discussed herein can be achieved independently in various embodiments of the present disclosure or may be combined in yet other embodiments, further details of which can be seen with reference to the following description and drawings.

DETAILED DESCRIPTION

The following detailed description is directed to technologies for reducing the risk of fluid-induced electrical shorting in electrical connectors. While the embodiments of the disclosure are described herein in the context of electrical connectors utilized in aircraft, it will be appreciated that embodiments of the disclosure are not limited to such applications, and that the techniques described herein may also be utilized to prevent fluid-induced electrical shorting in electrical connectors in other applications where the electrical connectors may be subject to fluid or moisture penetration.

In the following detailed description, references are made to the accompanying drawings that form a part hereof, and that show, by way of illustration, specific embodiments or examples. The drawings herein are not drawn to scale and the relative proportions of the various elements may be exaggerated to illustrate aspects of the disclosure. Like numerals represent like elements throughout the several figures.

Figure 1:
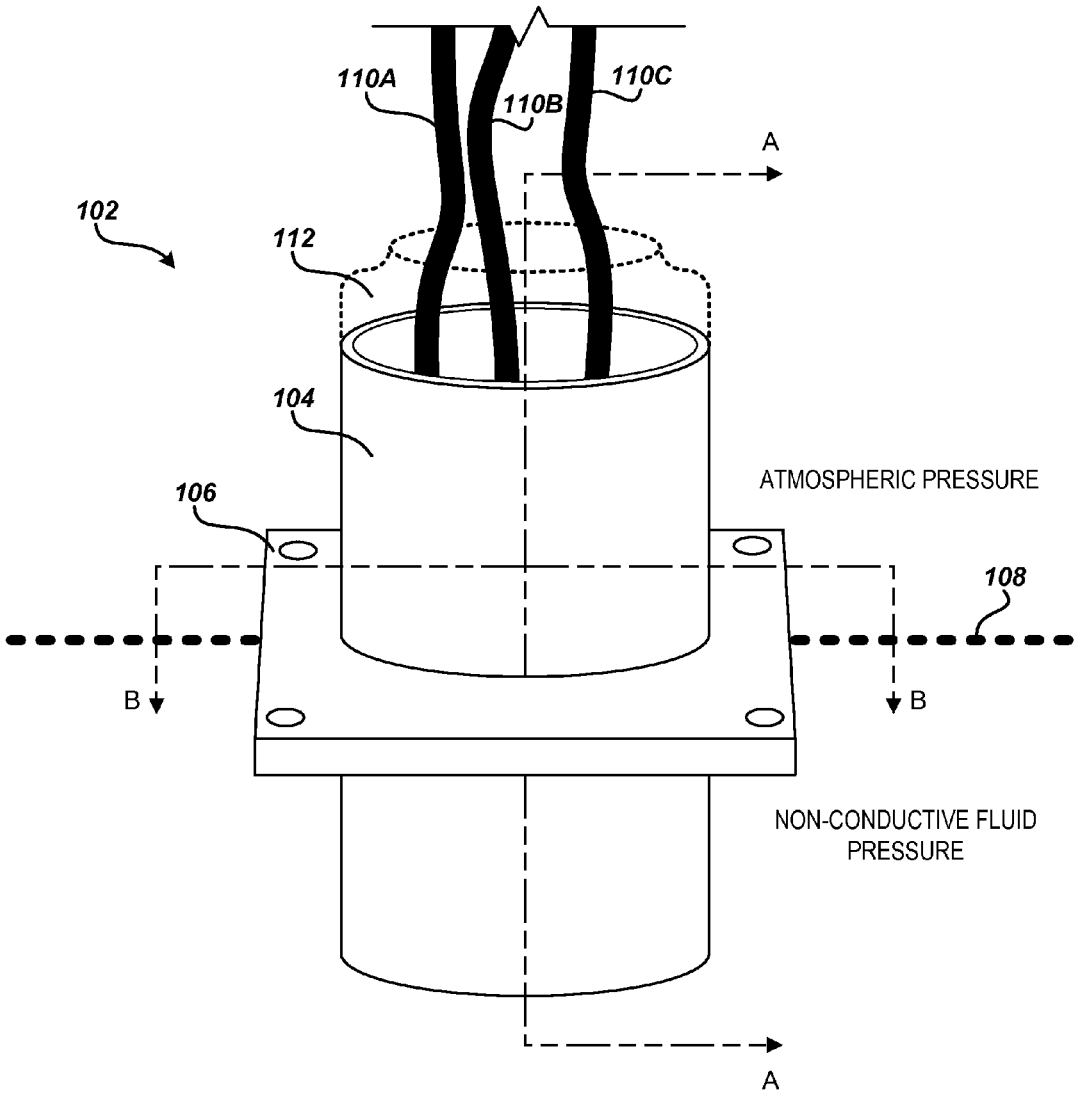
FIG. 1 (PRIOR ART)
FIG. 1 is a perspective view of an illustrative electrical connector, according to embodiments presented herein.

FIG. 1 shows an illustrative electrical connector 102. Specifically, FIG. 1 shows a perspective view of an electrical connector 102 utilized to connect power to fuel pumps located in the fuel tanks of an aircraft. The electrical connector 102 may comprise a shell 104 which passes through a flange 106. The flange 106 may be connected or bonded to a barrier 108 between the outside environment and the fuel tank, such as the skin of the aircraft, for example. The shell 104 and the flange 106 may be made from aluminum, steel, plastic, composites, or other suitable materials. One or more wires or conductors, such as conductors 110A-110C (referred to herein generally as conductors 110), may be soldered, crimped, or otherwise connected to the terminals or contacts of the electrical connector 102. The conductors 110 may be coated with a protective and/or insulating material, such as plastics or synthetic fluoropolymers, e.g. TEFLON® from E. I. du Pont de Nemours and Company of Wilmington, Del. The exposed opening of the shell 104 may be further filled with a potting compound 112, such as synthetic rubber, epoxy, fluoropolymer elastomers, and the like.

Figure 2:
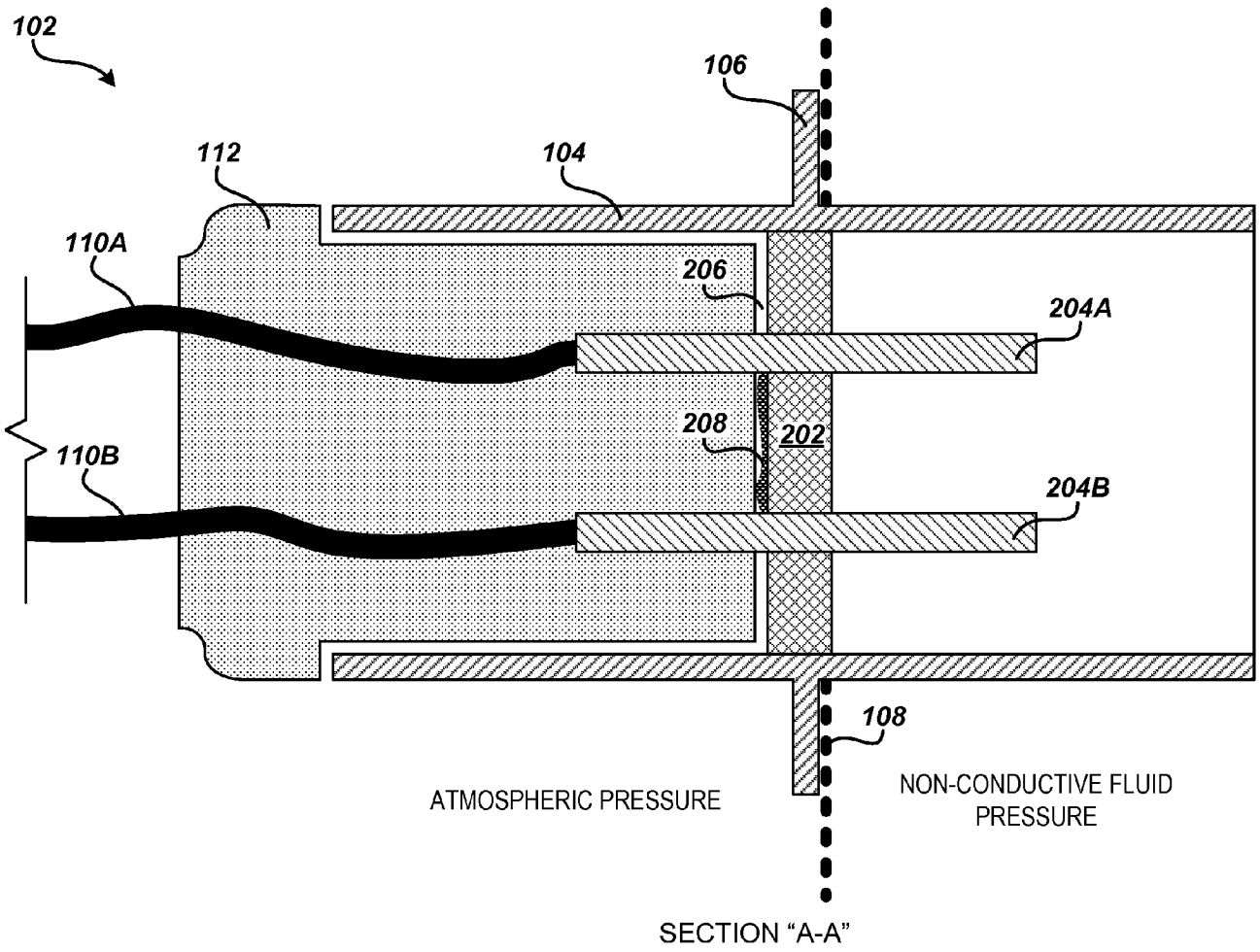
FIG. 2 (PRIOR ART)
FIG. 2 is a cross-sectional view of an illustrative electrical connector showing details of the problem addressed by the embodiments presented herein.

FIG. 2 shows a cross-sectional view of an illustrative electrical connector 102 taken substantially along sectional lines A-A of the connector shown in FIG. 1. As may be seen in the figure, the electrical connector 102 may further include a non-conductive member 202 that provides a hermetically-sealed pressure boundary between the fluid pressure in the fuel tank and the atmospheric pressure outside of the aircraft. The non-conductive member 202 may comprise a non-conductive disc or other component interposed between the opposite ends of the electrical connector inside of the shell 104, for example. According to some embodiments, the non-conductive member 202 may be manufactured from a dielectric material, such as glass or ceramic. Alternatively, the non-conductive member 202 may be manufactured from plastic or another suitable non-conductive material.

Terminals or contacts of the electrical connector 102, such as contacts 204A and 204B (referred to herein generally as contacts 204), may pass through and be held in-place by the non-conductive member 202. The contacts 204 may be configured to pass electrical signals and/or electricity from the conductors 110, through the non-conductive member 202, and to complementary contacts of an appropriate mating connector in the fuel tank. The contacts 204 may be made of any suitable conductive material. In some embodiments, the contacts 204 may be nickel-plated to provide for the soldering of the conductors 110A and 110B to the respective contacts 204A and 204B. Similarly, a gold plating may be added to the contacts 204 to prevent oxidation of the nickel plating and/or the underlying conductive material.

As may be further seen in the figure, the potting compound 112 may be injection-molded, poured, or otherwise introduced into the outside opening of the shell 104 of the electrical connector 102 to seal the shell and to protect the contacts 204 and the solder connections between the contacts and the conductors 110 from the outside atmosphere. The potting compound 112 may consists of synthetic rubbers, epoxies, fluoropolymer elastomers, e.g. VITON® from DuPont Performance Elastomers LLC, and/or any combination of these and other materials capable of being injected or introduced into the opening of the shell 104 and bonding with the inner walls of the shell, the conductors 110, the contacts 204, and/or the non-conductive member 202.

The resistance of the electrical connector 102 to water penetration into the shell 104 from the atmosphere may rely on the adhesion between the potting compound 112 and the inner walls of the shell and the non-conductive member 202 that holds the contacts 204. Lack of 100% adhesion between the potting compound 112 and the components of the electrical connector 102 may allow for small gaps or voids, such as void 206, to be created along the inner walls of the shell 104, along the surface of the non-conductive member 202, along the contacts 204, and the like. In addition, temperature variation and ice build-up inside the connector may increase the voids 206. Various conditions may allow moisture to penetrate the electrical connector 102 and accumulate in these voids 206. For example, differences in pressure between the voids 206 the outside atmosphere, such as those that may occur as the aircraft descends, may drive outside moisture between the shell 104 and the potting compound 112 or between the conductors 110 and the potting material and into the voids 206.

Moisture may further intrude into the electrical connector 102 between the conductors 110 and their TEFLON coating or other insulator via capillary action, and be drawn to the surface of the non-conductive member 202 along the gold-plated surface of the contacts 204, for example. Rapidly changing temperatures and temperature differentials may cause moisture in the voids 206 along the surface of the non-conductive member 202 to condense into a fluid state. The drop in pressure resulting from the condensation may further draw additional moist air into the electrical connector 102 from the outside atmosphere. If sufficient fluid builds up in a void 206 on the surface of the non-conductive member 202 between two contacts 204A and 204B, as shown at 208 in FIG. 2, an electrical short may occur between the contacts. This not only greatly reduces the useful life of the connector, but may also pose a substantial fire and safety hazard. A phase-to-phase power short, for example, could cause an arc that could burn through the shell 104 of the electrical connector 102.

Figure 3:
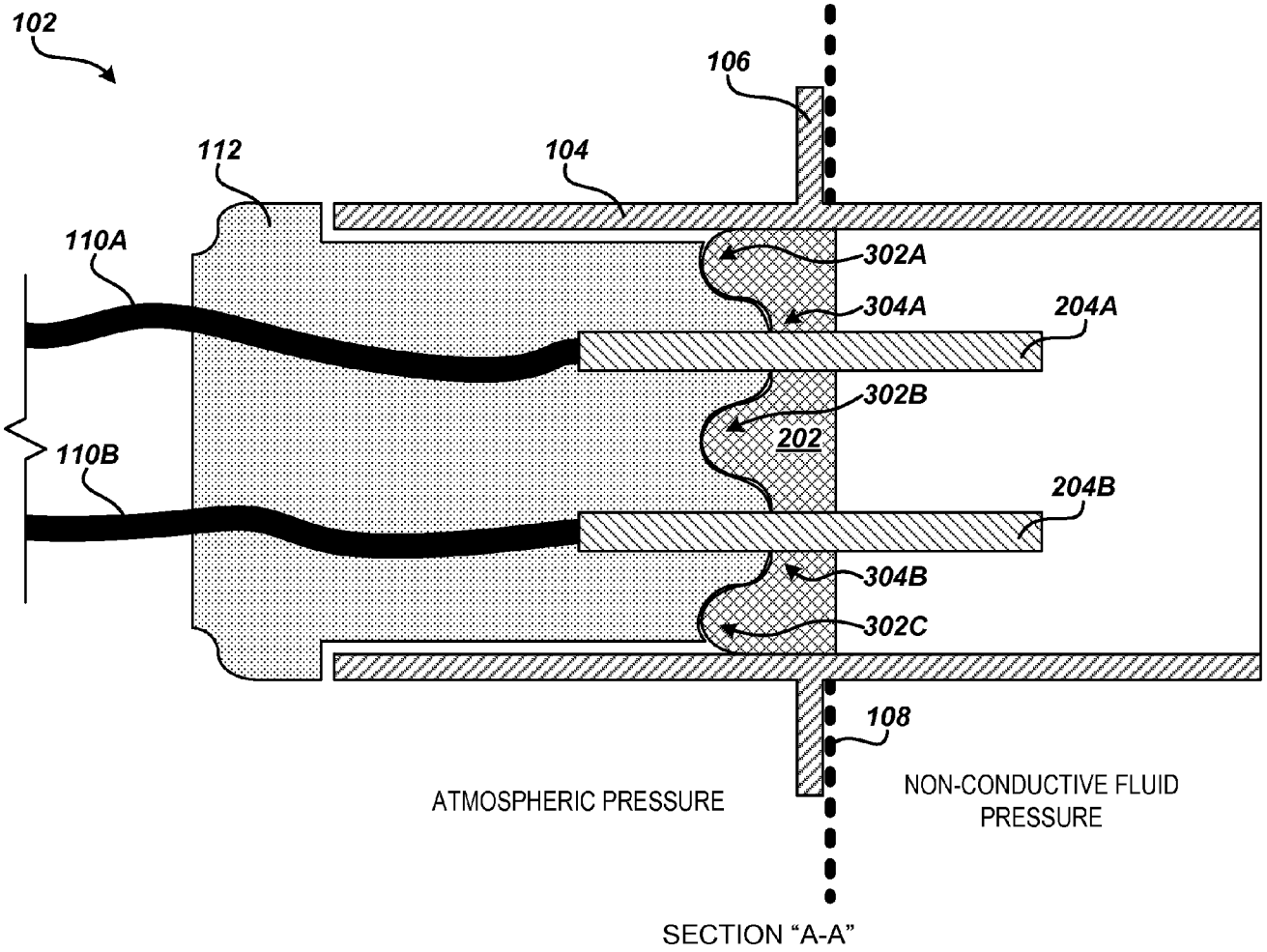
FIG. 3 is a cross-sectional view of an illustrative electrical connector showing aspects of the embodiments presented herein.

FIG. 3 shows a cross-sectional view of another illustrative electrical connector 102 taken substantially along sectional lines A-A of the connector shown in FIG. 1. According to embodiments, the non-conductive member 202 in this illustrative electrical connector 102 comprises one or more raised areas, protuberances, or projections, referred to herein as "peaks," along one surface, and formed as one piece with non-conductive member 202. For example, the non-conductive member 202 may have peaks 302A-302C (referred to herein generally as peaks 302) disposed on its internal surface, as shown in FIG. 3. According to embodiments, the peaks 302 on the surface of the non-conductive member 202 act as baffles that help prevent internal electrical shorting due to fluid intrusion. In some embodiments, the peaks 302 on the surface of the non-conductive member 202 are added between adjacent contacts 204, such the contacts are located in "wells" or valleys, such as valleys 304A and 304B, between the peaks. Stated differently, a length along the surface of the non-conductive member having the one or more peaks disposed therefrom between the pair of adjacent contacts is greater than a linear distance between the pair of adjacent contacts. This configuration serves to increase the "leak-path" distance along the surface of the non-conductive member 202 and between the adjacent contacts 204, reducing the chance of fluid build-up between contacts that may result in an electrical short. Further, the addition of the peaks 302 increases the surface area of the non-conductive member 202 to which the potting compound 112 may bond, potentially reducing or eliminating some voids 206 between the potting compound and the surface of the non-conductive member.

Figure 4:
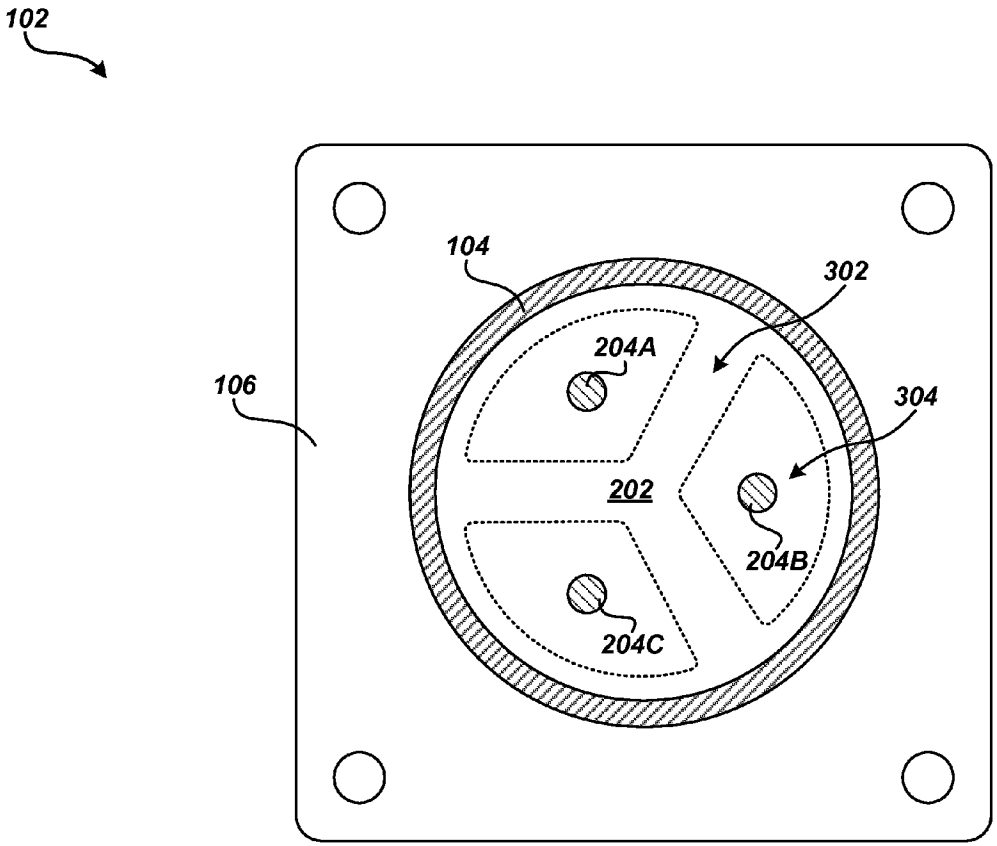
FIG. 4 is a cross-sectional view of the illustrative electrical connector showing additional aspects of the embodiments presented herein.

FIG. 4 shows another cross-sectional view of the illustrative electrical connector 102, taken substantially along sectional lines B-B of the connector shown in FIG. 1. As may be seen in this figure, the peaks 302 on the surface of the non-conductive members 202 separate and surround the contacts 204A-204C, resulting in the contacts being located in valleys, such as valley 304. While the figures and the description herein show a connector with three contacts 204, it will be appreciated that other configurations of the peaks 302 and valleys 304 on the surface of the non-conductive member 202 may be imagined that would accommodate electrical connectors 102 with 2, 4, 5, or more contacts. It is intended that this application include all such configurations.

Figure 5A:
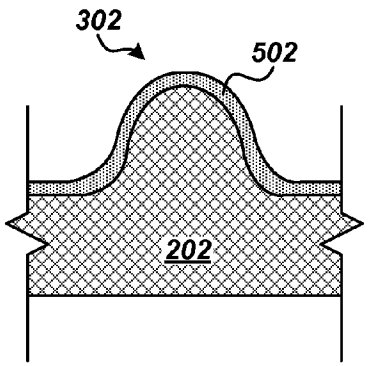
FIGS. 5A-5E are cross-sectional views of an illustrative non-conductive member showing additional aspects of the embodiments presented herein.
Figure 5B:
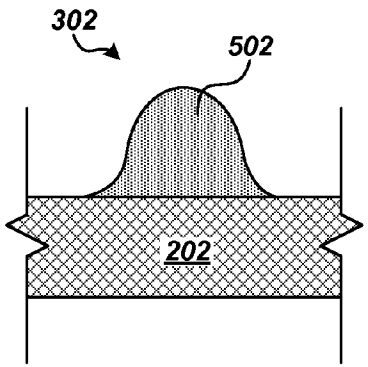

According to some embodiments, each peak 302 may result from the molding, forming, machining, or other manufacturing process of the non-conductive member 202, as shown in FIGS. 3 and 5A, such that the non-conductive member and the peaks are one integral component. In further embodiments, the surface of the non-conductive member 202 from which the peaks 302 are disposed may be coated with a material 502 having a low surface energy in order to cause any penetrating fluid to bead and resist spreading. The coating material 502 may also have good bonding properties with both the potting compound 112 and the material used to form the non-conductive member 202. In other embodiments, the peaks 302 may be formed by depositing a material 502 on the surface of the non-conductive member 202, as shown in FIG. 5B. The material 502 utilized to form the peaks 302 may have similar properties as described above to prevent the spread of fluid yet bond with the potting compound 112 and the non-conductive member 202. Examples of a material 502 may include any traditional bonding agents, including but not limited to, CHEMLOK® 5150 from LORD Corporation, and/or similar adhesive products.

Figure 5C:
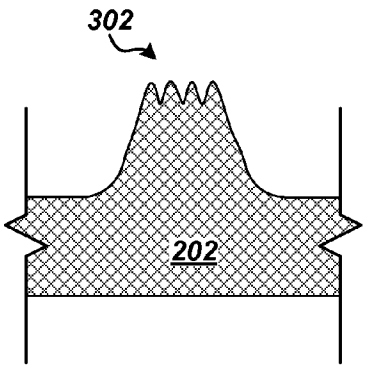
Figure 5D:
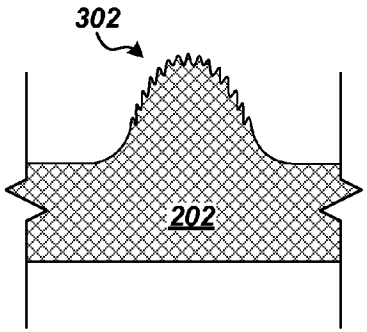
Figure 5E:
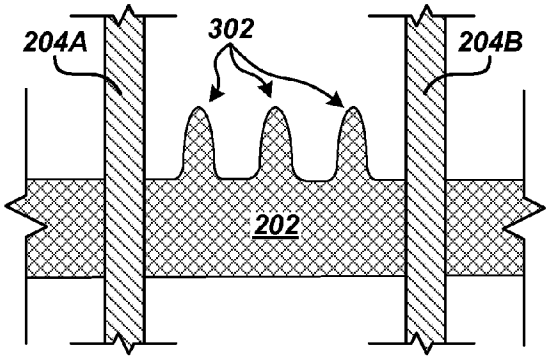

In additional embodiments, the peaks 302 may be formed with additional ridges or other features that further lengthen the leak-path between adjacent contacts 204 as well as provide additional surface area along the surface of the non-conductive member 202 for bonding with the potting compound 112, such as those shown in FIGS. 5C and 5D. In further embodiments, the surface of the non-conductive member 202 may have multiple peaks 302 between adjacent contacts 204A and 204B, as shown in FIG. 5E. Other configurations of the peaks 302 on the surface of the non-conductive member 202 may be imagined that lengthen the leak-path between contacts 204 as well as provide additional surface area for bonding with the potting compound 112 beyond those shown in the figures and described herein. It is intended that this application include all such configurations.

In further embodiments, grit blasting may be performed on the surface of the non-conductive member 202 from which the peaks 302 are disposed to further improve the bonding of the potting compound 112 with the surface of the non-conductive member. In addition, an arc-suppressing or arc-neutral material could be added to or utilized as the potting compound 112 in order to lessen the fire and safety hazard that may be presented by any electrical short that could otherwise occur.

Figure 6:
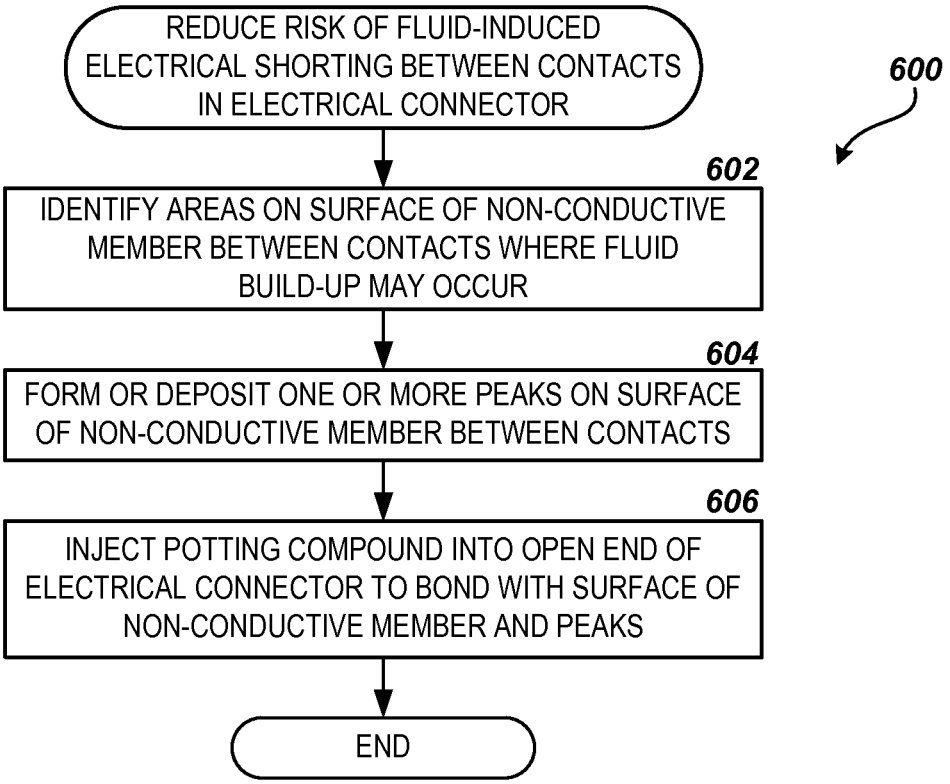
FIG. 6 is a flow diagram illustrating one method for reducing the risk of fluid-induced electrical shorting in electrical connectors, according to the embodiments described herein.

FIG. 6 shows a routine 600 for reducing the risk of fluid-induced electrical shorting in an electrical connector, according to one embodiment. The routine 600 may be utilized to reduce the risk of shorting between adjacent contacts, such as contacts 204A and 204B, in the electrical connector 102 shown in FIGS. 3 and 4, for example. The routine 600 begins at operation 602, where areas of possible fluid buildup between contacts 204 of the electrical connector 102 are identified. As described above in regard to FIG. 2, this may be a void 206 between the potting compound 112 and the internal surface of the non-conductive member 202 running between adjacent contacts 204A and 204B, for example. Moisture may penetrate the electrical connector 102 between the shell 104 and the potting compound and/or along the conductors 110 and contacts 204 and condense into a fluid in the void 206, as further shown at 208 in FIG. 2. This buildup of fluid may then cause an electrical short to occur between the adjacent contacts 204A and 204B.

From operation 602, the routine 600 proceeds to operation 604, where one or more peaks are formed or deposited on the internal surface of the non-conductive member 202 of the electrical connector 102 in the identified areas between contacts 204, as shown in FIGS. 3 and 4. The addition of the peaks 302 to the surface of the non-conductive member 202 increases the leak-path distance along the surface of the non-conductive member 202 between contacts 204, thus reducing the risk of fluid buildup between adjacent contacts that may result in an electrical short in the electrical connector 102. In some embodiments, the peaks 302 on the surface of the non-conductive member 202 are configured such that all of the contacts 204 are located in "wells" or valleys, such as valleys 304A and 304B further shown in FIGS. 3 and 4.

According to some embodiments, the peaks 302 may be formed with the non-conductive member 202 as single integral piece or component during its manufacture. In other embodiments, the peaks 302 may be added by depositing a material 502 on the surface of the non-conductive member 202, as shown in FIG. 5B. The material 502 utilized to form the peaks 302 may have a low surface energy such as to prevent the spread of fluid, as well as having good bonding adhesion with the potting compound 112 and the non-conductive member 202. In further embodiments, the peaks 302 may include ridges or other features that further lengthen the leak-path between contacts 204 as well as provide additional surface area along the surface of the non-conductive member 202 for bonding with the potting compound 112, such as those shown in FIGS. 5C and 5D. In further embodiments, the surface of the non-conductive member 202 may have multiple peaks 302 between each contact 204, as shown in FIG. 5E. In additional embodiments, the entire surface of the non-conductive member 202 from which the peaks 302 are disposed may be coated with a low surface energy material 502, as shown in FIG. 5A, to further reduce fluid migration.

The routine 600 proceeds from operation 604 to operation 606, where the potting compound is injection-molded or otherwise introduced into the open end of the shell 104 of the electrical connector 102 to bond with the walls of the shell, the contacts 204 and conductors 110, and the internal surface of the non-conductive member 202. The addition of the peaks 302 to the internal surface of the non-conductive member 202 further provides additional surface area of the non-conductive member to which the potting compound 112 may bond, potentially eliminating voids 206 between the surface of the non-conductive member and potting compound that run the entire length along the surface of the non-conductive member between adjacent contacts 204. This may further reduce the risk of the buildup of fluid between the contacts 204 that could cause an electrical short. From operation 606, the routine 600 ends.

Based on the foregoing, it should be appreciated that technologies for reducing the risk of fluid-induced electrical shorting in electrical connectors are provided herein. The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. An electrical connector comprising:

a non-conductive member interposed between a first end and a second end of the electrical connector and configured to support a plurality of electrical contacts, the plurality of electrical contacts configured to conduct electrical signals through the non-conductive member, the non-conductive member having one or more peaks disposed on a surface of the non-conductive member between at least one pair of adjacent electrical contacts, and the non-conductive member having valleys disposed on the surface of the non-conductive member, wherein each electrical contact of the at least one pair of adjacent electrical contacts being located in the valleys and one of the one or more peaks forming a ridge surrounding each electrical contact, wherein the non-conductive member comprises a dielectric material of one of glass or ceramic and forms a pressure boundary between the first end and the second end of the electric connector.

2. The electrical connector of claim 1, wherein the one or more peaks comprise a material having low surface energy material deposited on the surface of the non-conductive member.

3. The electrical connector of claim 1, wherein the one or more peaks are formed as one piece with the non-conductive member.

4. The electrical connector of claim 1, wherein the surface of the non-conductive member having the one or more peaks disposed therefrom is coated with a low surface energy material.

5. The electrical connector of claim 1, wherein a length along the surface of the non-conductive member having the one or more peaks disposed therefrom between the pair of adjacent contacts is greater than a linear distance between the pair of adjacent contacts.

6. The electrical connector of claim 1, wherein a first surface area of the surface of the non-conductive member having the one or more peaks disposed therefrom is greater than a second surface area of an opposing surface of the non-conductive member.

7. The electrical connector of claim 1, further comprising a potting compound introduced into an open end of the electrical connector to bond with at least the surface of the non-conductive member.

8. A method for reducing a risk of a fluid-induced electrical short between contacts in an electrical connector, the method comprising:

providing a non-conductive member comprising a dielectric material of one of glass or ceramic between the contacts of the electrical connector;

disposing one or more peaks on a surface of the non-conducting member forming a ridge surrounding each of the contacts, where the one or more peaks comprise the dielectric material of one of glass or ceramic;

disposing valleys on the surface of the non-conductive member, wherein each contact of the electrical connector being located in the valleys; and forming a pressure boundary between a first end and a second end of the electric connector by providing the non-conductive member between the first and second end of the electrical connector.

9. The method of claim 8, wherein disposing the one or more peaks on the surface of the non-conducting member increases a leak-path distance along the surface of the non-conductive member between the contacts.

10. The method of claim 8, further comprising introducing a potting compound into an open end of the electrical connector to bond with the surface of the non-conductive member, wherein disposing the one or more peaks on the surface of the non-conducting member increases a surface area of the surface of the non-conductive member to which the potting compound may bond.

11. The method of claim 8, wherein disposing the one or more peaks on the surface of the non-conductive member comprises forming the one or more peaks and the non-conductive member as one integral component.

12. The method of claim 11, further comprising coating the surface of the non-conductive member having the one or more peaks disposed therefrom with a low surface energy material.

13. A system comprising:

a shell;

a plurality of contacts configured to conduct electrical signals; and a non-conductive member interposed between a first end and a second end of the shell and configured to support the plurality of contacts, where the non-conductive member comprises a peak disposed on a surface of the non-conductive member between at least one pair of adjacent electrical contacts, the peak forming a ridge surrounding each electrical contact, and valleys disposed on the surface of the non-conductive member, wherein each electrical contact of the at least one pair of adjacent electrical contacts being located in the valleys such that a leak-path distance along the surface of the non-conductive member between the pair of adjacent contacts is greater than a linear distance between the pair of adjacent contacts, wherein the non-conductive member comprise a dielectric material of one of glass or ceramic and forms a pressure boundary between the first end and the second end of the shell.

14. The system of claim 13, further comprising a potting compound introduced into an open end of the shell to bond with the surface of the non-conductive member, wherein the peak disposed on the surface of the non-conducting member increases a surface area of the surface of the non-conductive member to which the potting compound may bond.

15. The system of claim 13, wherein the peak is formed as one piece with the non-conductive member.

* * * * *